US010882344B2

(12) United States Patent
Williams et al.

(10) Patent No.: US 10,882,344 B2
(45) **Date of Patent: *Jan. 5, 2021**

(54) REPLACEABLE PRINTING SUBASSEMBLY

(71) Applicant: Hewlett-Packard Development Company, L.P., Houston, TX (US)

(72) Inventors: Kenneth Williams, Vancouver, WA (US); Matt G Driggers, Vancouver, WA (US); Bruce A McFadden, Vancouver, WA (US); Bill Osborne, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/082,604

(22) PCT Filed: Jun. 15, 2016

(86) PCT No.: PCT/US2016/037624

§ 371 (c)(1),
(2) Date: Sep. 6, 2018

(87) PCT Pub. No.: WO2017/217981

PCT Pub. Date: Dec. 21, 2017

(65) Prior Publication Data

US 2019/0092057 A1 Mar. 28, 2019

(51) Int. Cl.
*B41J 25/34* (2006.01)
*B41J 2/175* (2006.01)
(Continued)

(52) U.S. Cl.
CPC ..... *B41J 25/34* (2013.01); *B41J 2/155* (2013.01); *B41J 2/175* (2013.01); *B41J 2/2146* (2013.01);
(Continued)

(58) Field of Classification Search
CPC . B41J 25/34; B41J 29/02; B41J 2/2146; B41J 2/155; B41J 29/38; B41J 29/393; B41J 2/175; B41J 2002/20
See application file for complete search history.

(56) References Cited

U.S. PATENT DOCUMENTS 6,595,619 B2 7/2003 Barinaga et al.
8,042,910 B2 10/2011 Ray et al.
(Continued)

FOREIGN PATENT DOCUMENTS

CN 1130129 A 9/1996
CN 1265478 A 9/2000
(Continued)

OTHER PUBLICATIONS

Hewlett-Packard Development Company, L.P. Technology Backgrounder: HP T300 Color Inkjet Web Press. Aug. 2009~16 pages.

*Primary Examiner* — Sharon Polk
(74) *Attorney, Agent, or Firm* — Dicke Billig & Czaja PLLC

(57) ABSTRACT

A replaceable printing subassembly is disclosed. The replaceable printing subassembly includes a printbar. A fluid delivery system including a pump is fluidically coupled to the printbar. A frame is coupled to the fluid delivery system. The replaceable printing subassembly also includes a lift mechanism having an actuator to selectively move the printbar with respect to the frame.

13 Claims, 3 Drawing Sheets

(51) Int. Cl.

| | |
|---|---|
| ***B41J 2/21*** | (2006.01) |
| ***B41J 29/38*** | (2006.01) |
| ***B41J 29/393*** | (2006.01) |
| ***B41J 2/155*** | (2006.01) |
| ***B41J 29/02*** | (2006.01) |

(52) U.S. Cl.
CPC ..... *B41J 29/02* (2013.01); *B41J 29/38* (2013.01); *B41J 29/393* (2013.01); *B41J 2202/20* (2013.01)

(56) References Cited

U.S. PATENT DOCUMENTS

| | | | |
|---|---|---|---|
| 8,205,965 | B2 | 6/2012 | Scheffelin et al. |
| 10,647,126 | B2 * | 5/2020 | Williams ..... B41J 2/175 |
| 2008/0174636 | A1 | 7/2008 | Kim et al. |
| 2009/0295872 | A1 | 12/2009 | Ray |
| 2010/0259580 | A1 | 10/2010 | Tsuji |
| 2012/0169821 | A1 | 7/2012 | Meier et al. |
| 2012/0194607 | A1 | 8/2012 | Iwasa et al. |
| 2015/0183309 | A1 | 12/2015 | Dowell |

FOREIGN PATENT DOCUMENTS

| | | | |
|---|---|---|---|
| CN | 1636752 | | 7/2005 |
| CN | 1978202 | | 6/2007 |
| CN | 200995522 | | 12/2007 |
| CN | 101503029 | A | 8/2009 |
| CN | 201362032 | Y | 12/2009 |
| EP | 2481587 | | 8/2012 |
| JP | 2008173964 | | 7/2008 |
| JP | 2008254189 | | 10/2008 |
| JP | 2012025053 | | 2/2012 |
| JP | 2012157988 | | 8/2012 |
| JP | 2012158036 | A | 8/2012 |
| JP | 2012166554 | | 9/2012 |
| JP | 2014188813 | | 10/2014 |
| JP | 2015051583 | | 3/2015 |
| JP | 2015051589 | | 3/2015 |
| JP | 2015058698 | | 3/2015 |

* cited by examiner

REPLACEABLE PRINTING SUBASSEMBLY

BACKGROUND

Printing devices—including printers, copiers, fax machines, multifunction devices including additional scanning, copying, and finishing functions, all-in-one devices, or other devices such as pad printers to print images on three-dimensional objects and three-dimensional printers (additive manufacturing)—receive digital images or digital models and produce objects or images on media such as plain paper, photo paper, transparencies, and other media. In some examples, printing devices are sheet fed devices that can print on media stacks of metals and polymeric media in addition to or instead of broad and thin media. Media is positioned as a media stack in an input media tray or on a media roll. Images can be obtained directly from the printing device or communicated to the printing device from a remote location such as from a computing device or computing network. In the example of a sheet fed device, a sheet is selected from the media stack, typically one item at a time, and fed through a media support along a feedpath to an output tray. In a roll fed device, a web of media is fed through a media support along the feedpath to an output. The media interacts with printheads at the media support to produce images on the media. Three-dimensional printers receive a digital model or other data source of an object and can form successive layers of material to produce a three-dimensional object, such as via printer heads, extrusion, sintering-based processes or other processes.

DETAILED DESCRIPTION

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims. It is to be understood that features of the various examples described herein may be combined, in part or whole, with each other, unless specifically noted otherwise.

Many commercially used printing devices, such as inkjet printers in offices, schools, and laboratories, are repaired on site rather than being returned to a factory. A technician is often dispatched in short order to the printer where the maintenance is performed based on a service contract. If repairs are too frequent and too involved, business suffers or users become frustrated with the inability to use the printing device or the expense of the service contract.

In many examples, commercially used printing devices are sturdily built but difficult to repair. In one example, a printing device may have a difficult to repair printbar, which includes a set of print heads spanning a width of media and may be prone to fail from time to time. The repair of a printbar may involve initially removing the scanner or document feeder and disassemble part of the components of the feedpath and data cables. If a printbar has failed or is in disrepair, it is likely that associated parts such as drive motors, gears, bearings, and other features are also nearing the end of service life. These parts can also be difficult to repair and are also replaced one-by-one often in separate service visits. The repair of difficult to access small parts at disparate service intervals can lead to costly repair visits for relatively inexpensive components, repeated service visits, and long repair times.

Figure 1:
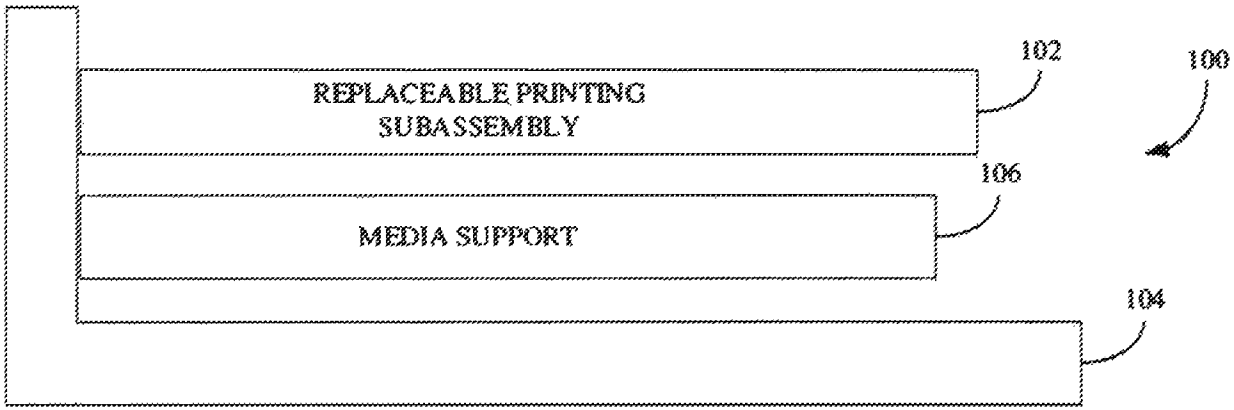
FIG. 1 is a schematic diagram illustrating an example printing device.

FIG. 1 illustrates an example printing device 100 having a replaceable printing subassembly 102. Exemplars of the printing device 100 can include one or combinations of two or more of a printer, scanner, copier, fax machine, plotters, or other devices such as pad printers or three-dimensional printers. The printing device 100 can be operated as one or combinations of two or more of a stand alone device, a device coupled to a computer network, or a peripheral or auxiliary device operated by a computer or other processing device. In one example, the printing device 100 is an inkjet printer. Print media can include paper, plastic, fabric, in various sizes and types, such as 8.5 by 11 inch paper, A4 paper, roll feed media, and other media.

The disclosure includes examples in the context of inkjet printing on a medium for illustration. Although specific examples may refer to one or more of these printing devices or to one or more of printing media, such examples are meant for illustration and not meant to limit description. Additionally, the examples are not intended to be limited to ink or printing on media, and can include dispensing, ejecting, or otherwise depositing of incompressible fluids other than ink for uses other than printing on media.

The printing device 100 includes a chassis 104 and a media support mechanism 106. The replaceable printing subassembly 102 is removably coupled to the chassis 104 and selectively positionable with respect to the media support mechanism 106. In one example, the media support mechanism 106 is configured to hold or present media for printing. The replaceable printing subassembly 102 is configured to print or mark on the media mechanism 106. The replaceable printing subassembly 102, in one example, includes a printbar and the components to hold, move, protect, and supply ink to the printbar. In one example, the printbar and components of the subassembly 102 are not intended to be repaired or repaired in the field. Instead, a serviceable subassembly 102 can be removed from the printing device 100 and replaced with a new subassembly.

In one example, the printbar includes print heads spanning the width of the media for printing. The printbar can include a printing portion intended to print on the media. The printing portion of the printbar spans the width of the media intended for printing. For example, a printing portion can be at or over 8.5 inches long for a letter size (8.5 inches by 11 inches) sheet of media. The printbar can include multiple print dice in a print head and multiple print heads spanning the width of the printing portion. Accordingly, the print heads do not move across the width of the media during printing. In one example, a die can be configured to print cyan and magenta and another die can be configured to print black and yellow. These dice can be coupled together in a print head, and multiple print heads are positioned in a media-wide, or page-wide, array, on the print portion.

Figure 2:
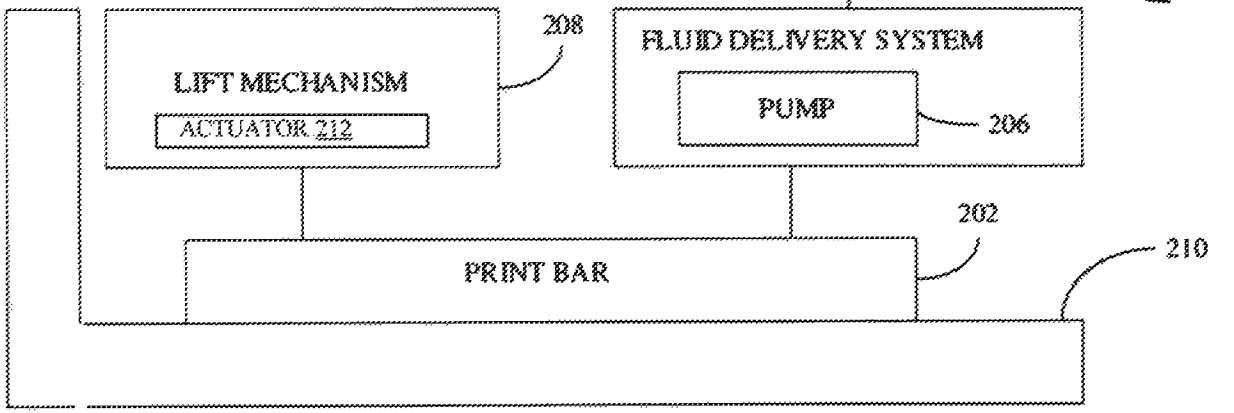
FIG. 2 is a schematic diagram illustrating an example of a replaceable printing subassembly for the printing device of FIG. 1.

FIG. 2 illustrates an example replaceable printing subassembly 200 corresponding with the subassembly 102 in printing device 100 (see FIG. 1). Example subassembly 200 includes a print bar 202, fluid delivery system 204 including a pump 206 fluidically coupled to the print bar 202, and a lift mechanism 208 coupled to a subassembly frame 210. By being fluidically coupled, the pump 206 is in fluid communication with the print bar 202. The lift mechanism 208 includes an actuator 212 to selectively move and position the print bar 202 with respect to the subassembly frame 210. When installed in a printing device, such as printing device 100, the lift mechanism 208 selectively moves and positions the print bar 202 with respect to a media support mechanism, such as media support mechanism 106. The modular design of the subassembly 200 allows print bar-related calibrations and adjustments—such as pen-to-paper spacing, lift drive backlash equalization, and others—to be performed during manufacture instead of in the field during servicing, which can save time during repair.

Service problems of the subassembly 200 will likely be the result of a maintenance issues with the printbar 202, a more expensive component of the subassembly 200. Replacement of the subassembly will also effectively provide preventative maintenance to the associated components of the fluid delivery system 204 and lift mechanism 208. Thus, replacement of the subassembly 200 in the case of a failed printbar 202 also provides for preventative maintenance of the associated components, which reduces overall repair costs and service visits.

Figure 3:
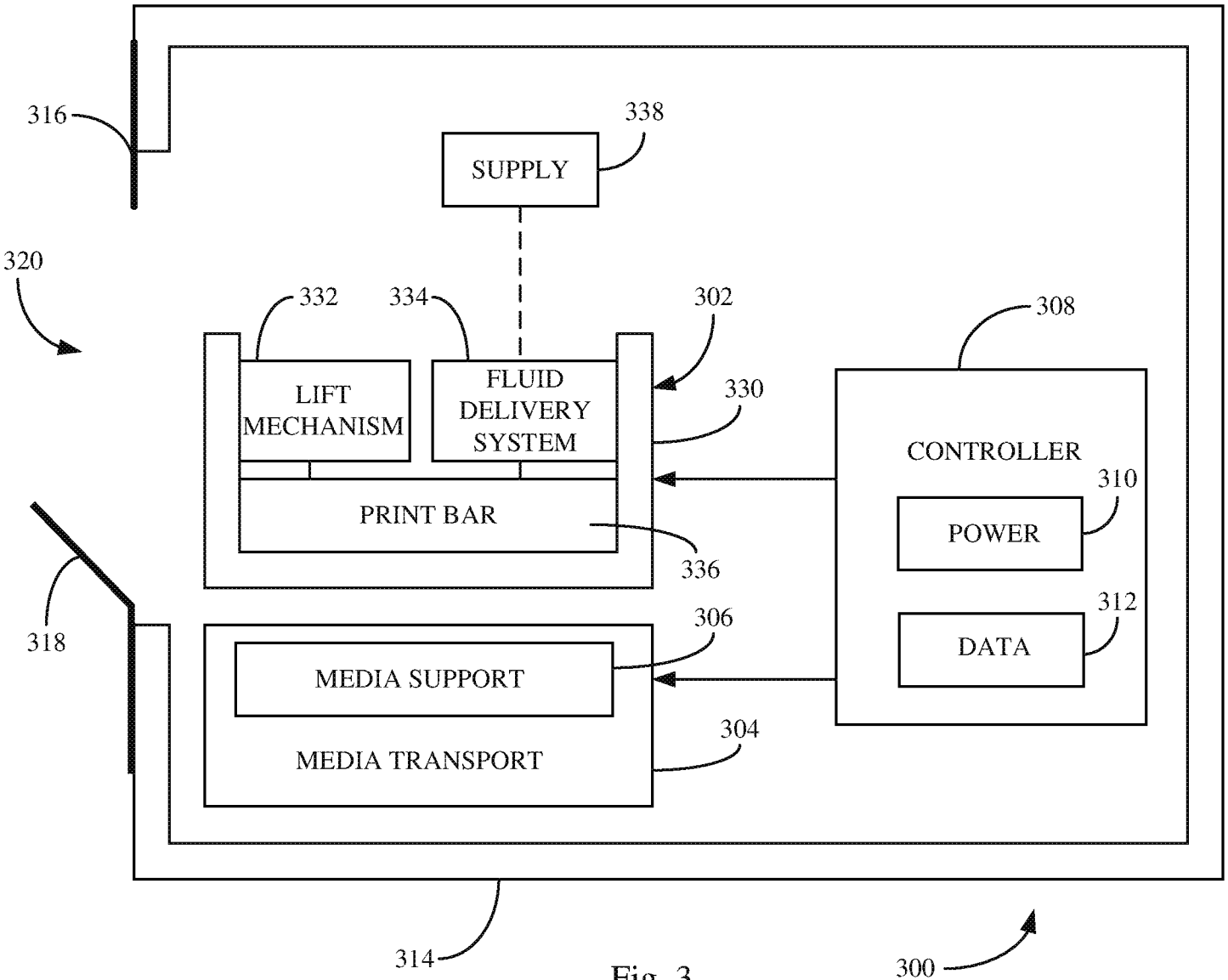
FIG. 3 is a schematic diagram illustrating an example printing device of the printing device of FIG. 1 including an example of printing subassembly of FIG. 2.

FIG. 3 illustrates an example of printing device 300, generally corresponding with printing device 100, having a replaceable printing subassembly 302. In the example, a media transport system 304 including a media support 306 is adapted to present media for marking with the replaceable printing subassembly 302. For example, the media transport system 304 can include mechanisms to deliver media in the form of one of sheets or a web roll to the subassembly 302. A controller 308, including a processor, memory, and can include communication circuitry and other features, is coupled to the media transport system 304 to control the media transport system 304. The controller 308 can include a power circuit 310 and image processing circuitry 312 coupled to the subassembly 302 to provide power and data, such as image data, to operate the subassembly 302. In one example, the controller 308 provides power and data signals to the subassembly 302 via electrical connections, optical connections, or both. For instance, the controller can provide power and data via detachable electrical conductors electrically coupled to the subassembly 302.

Printing device 300 further includes a chassis 314. The subassembly 302 is removably attached to the chassis 314 with a mechanical fastener such as screws or clamps. For example, the subassembly 302 can include a frame coupleable to a plurality of screws that can removably attach the subassembly 302 to the chassis 314. The subassembly 302 also includes signal pathways that can be removably attached to the controller 308. For example, the subassembly can include a plurality of flat flexible circuits having detachable signal couplings that can be operably connected to receive power and data from the controller 308.

In the illustrated example, the chassis 314 is coupled to and surrounded by a housing 316. The housing 316 can include an opening 320, and a cover 318 is selectively placed over an opening 320. In one example, the cover 318 can be detached, i.e., removably attached, from the housing 316 to expose the subassembly 302 within the housing 316 via the opening 320. In another example, the cover 318 remains attached to the housing 316, such as via a hinge or other mechanism, and is selectively moved away from the opening 320 to provide access to the subassembly 302. In one example, the opening 320 is large enough to allow a technician to detach the subassembly 302 from the chassis 314 and from the controller 308 and remove the subassembly 302 through the opening 320. The mechanical fasteners to the chassis 314 and signal connectors to the controller 308 are readily accessible via the opening to remove the subassembly 302. Further, a replacement subassembly can be reattached to the controller and connected to the frame and aligned with the media support 306 via the opening 320. Another example housing includes multiple openings including opening 320 to access the fasteners and electrical connections to the subassembly 302.

Replaceable printing subassembly 302 includes a lift mechanism 332 and fluid delivery system 334 coupled to the frame 330. A printbar 336 is fluidically attached to the fluid delivery system 334, i.e., the printbar 336 is in fluid communication with the fluid delivery system 334, and operably coupled to the lift mechanism 332. The fluid delivery system 334 is fluidically coupled to a fluid supply, such as ink supply 338. Ink supply 338 can include replaceable ink containers fluidically couplable to the fluid delivery system 334 such as via needle and septum. In one example, the replaceable ink containers can be included on the subassembly 302 wherein the frame 330 includes a section to hold the ink supply 338. In another example, the ink supply 338 can be located off of the subassembly 302 and coupled to the fluid delivery system via flexible tubing. Ink supply 338 can be accessed via opening 320 or via one or more other openings in housing 316 configured to introduce or replace ink containers.

Printbar 336 includes one or more print heads for dispensing ink. In the example, the printbar 336 spans the width of print media on media support 306 such that the printbar 336 does not traverse back and forth across the width of the print media to dispense ink. The lift mechanism 332, powered by the controller 308, positions the printbar 336 proximate the print media on the media support 306 for printing. Positioning of the printbar 336 can be based on the type of media in media transport system 304. The lift mechanism 332 can also position the printbar 336 distal to the media support when not printing or marking on media.

Figure 4:
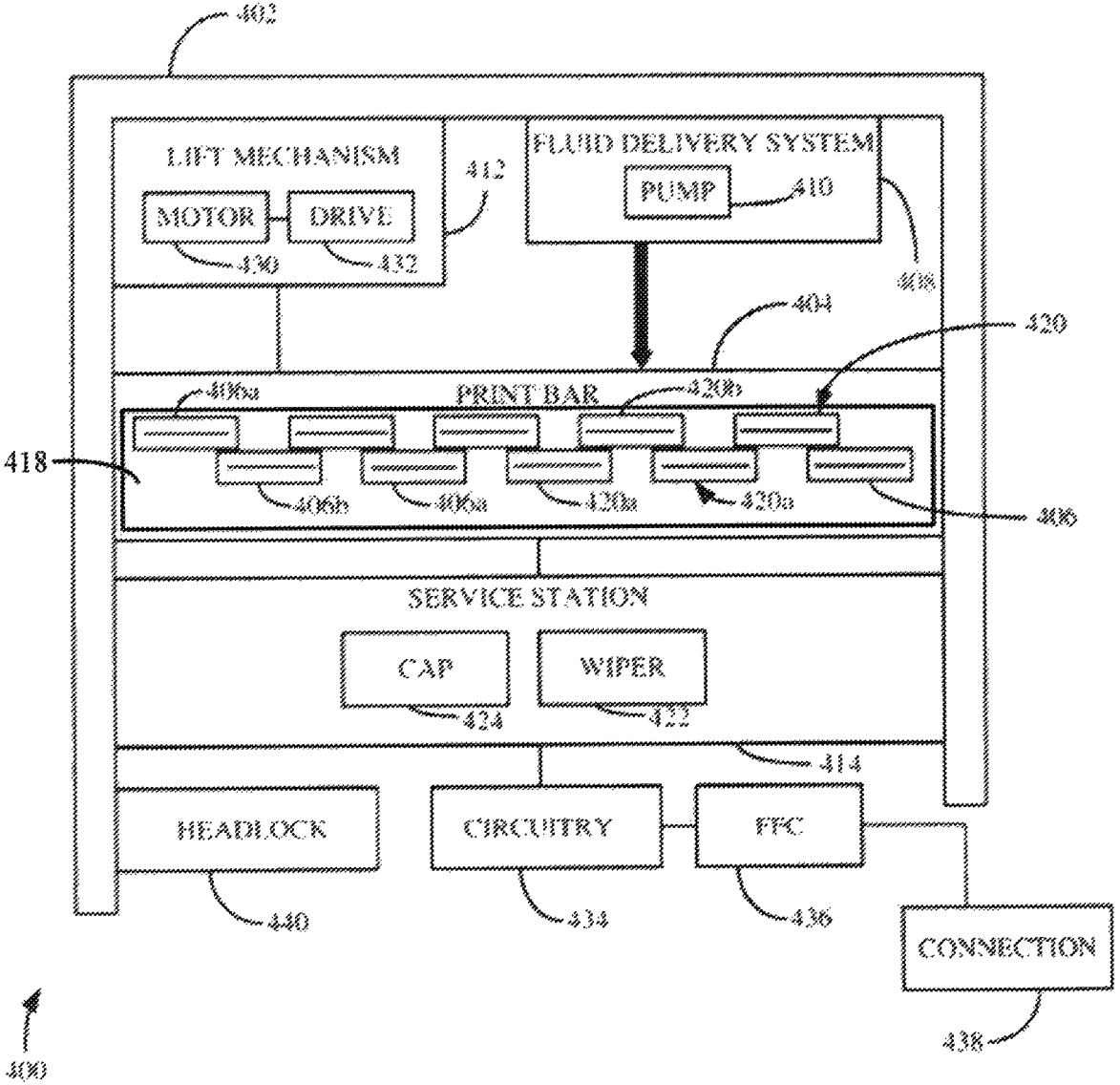
FIG. 4 is a schematic diagram illustrating an example of a replaceable printing subassembly of the replaceable printing subassembly of FIG. 3.

FIG. 4 illustrates an example of a replaceable printing subassembly 400 that can be suitable for use in the printing device 300. The subassembly 400 includes a frame 402 for supporting a print bar 404 having a plurality of print heads 406 configured to span the width of a printing media. The frame 402 further includes a fluid delivery system 408 including a pump 410 fluidically coupled to the print bar 404, a lift mechanism 412 coupled to the subassembly frame 402, and a service station 414.

Printbar 404 includes a printbar element 418 and one or more pens 420 for printing. In one example, the printbar 404 includes multiple pens **420*a*-420*n* arranged end-on-end on printbar element 418 with part of each pen overlapping a part of an adjacent pen. A printbar 404 can include, for example, two or more rows of pens 420 in a staggered configuration in which one pen 420 in each row extends into the overlap between pen 420 for seamless printing across much of the span of the printbar 404. In one example, the configuration of the pen 420** can provide for seamless printing the full span of the print media.

Pens 420 include mechanisms configured to eject an incompressible fluid onto media such as ink, for instance, on a web or sheet. Pens 420 each include one or more print heads 406*a*-406*n*. In one example, pens 420 each include a self-contained reservoir or cache of fluid that is applied to the print heads 406. In one example, print heads 406 include thermal resistive drop-on-demand inkjet print heads. In another example, print heads can include piezo-resistive inkjet print heads. In still another example, print heads may comprise other mechanisms configured to eject fluid in a controlled manner.

In the example of thermal resistive inkjet print heads 406, a heating element is located with individualized nozzles that eject ink. An electric current is applied to the heat the heating element and cause a small volume of ink to rapidly heat and become vaporized. Vaporized ink forms a pressurized bubble that ejects fluid ink through the nozzle as the ink expands. A print head driver circuit is coupled to the individual heating elements to provide energy pulses and control the ejection of liquid ink and thus the deposition of ink drops from the nozzles. The print head drivers are responsive to character generators and other image forming circuitry, which can be included as part of controller 308, for example, to energize selected nozzles of the print head to form images on the print media.

The reservoir is supplied with fluid from a fluid delivery system 408. In one example, each print head 406 is fluidically connected to its ink supply container, such as ink supply 338, with a needle and septum for each color. In another example, the fluid delivery system 408 supplies each of the pens 420 with a color from ink containers that provide ink to the print bar 404. In one example, the colors—such as black, cyan, magenta, and yellow (K, C, M, Y), and in some instances a bonding agent—are each supplied from one or more ink containers that are provided via pump 410 to each pen 420. The fluid delivery system 408 can include flexible tubing to form a fluid path between to the ink supply containers and the pump 410 and between the pump 410 and pens 420. A sheathed needle on the fluid delivery system 408 engages a septum on the ink supply container as the print head 406 is pushed and latched into place. Manual handling of fluid tubes is eliminated.

The replaceable print subassembly 400 also includes a service station 414 coupled to the frame 402. During printing, ink tends to build up at the nozzles of the print head 406. Ink build-up or residual ink can be caused from ink droplets that are not completely ejected, excess ink around the nozzle, and ink splatter reflected from the print media. The nozzles are also susceptible to being clogged from dust, quick drying ink, ink solids, and media particles. Service station 414 includes wipers 422 to clean and preserve the functionality of the print heads 406 and a cap 424 to cover the print heads 406 when not in use to reduce the likelihood of ink drying or contaminants from collecting in and over the nozzles. A service drive can move the wipers 422 from a print position to a service position to clean the print heads on the print bar and move the caps 424 from a print position to a service position to cover the print heads 406 of the print bar 404.

Lift mechanism 412 includes lift motor 430 and lift drive 432 to operate and move gears, such as rack, a pinion, or other gears, along a lift guide coupled to, or integrally formed with the frame 402. The lift motor 430 and drive 432 move printbar 404 from a remote position to a print position in response to signals provided from a controller to print on media. The lift mechanism can be used to space the printbar 404 a selected distance from a media support in response to signals provided from a controller based on the type of print media. The lift motor 430 and drive 432 move the printbar 404 from a print position proximate a media support to a remote position distal from the media support when not printing.

Subassembly 400 can include circuitry 434 to provide appropriate power and actuation signals to the pump 410, lift mechanism 412, and service station 414, as well as signals to the pens 420. In one example, the circuitry 434 is included on one or more printed circuit assemblies that include one or more flat flexible circuits 436 (FFC 436) having signal connectors 438 that can be operably coupled to receive power and data signals from a controller. In one example, the flat flexible circuits 436 are configured not to overlap in order to reduce cross-talk or electromagnetic interference. The fixed position of signal lines in the flat flexible circuits 436 avoid overlap if components of the subassembly 400 were separately installed or repaired and care was not given to the corresponding wiring attached to the controller.

Additionally, subassembly can include a repositionable headlock 440 coupled to the frame 402 to protect the print heads 406 during transport. In one example, the headlock 440 is engaged when the subassembly is not installed within a printing device. The headlock 440 protects the print head dice, which are susceptible to damage, during transport, in one example, by restricting the motion of the printbar 404. In another example, the headlock 440 is engaged when the printbar is capped with cap 424 of service station 414 to protect the print head dice during transport of the printing device.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

The invention claimed is:

1. A printing device, comprising:
- a chassis;
- a media support mechanism; and
- a replaceable printing subassembly removably coupled to the chassis, the replaceable printing subassembly including:
  - a printbar,
  - a fluid delivery system including a pump coupled to the printbar, and
  - a drive mechanism to position the printbar with respect to the media support mechanism.

2. The printing device of claim 1 including an inkjet printer.

3. The printing device of claim 2 wherein the inkjet printer is sheet fed.

4. The printing device of claim 1 wherein the chassis includes a housing having an opening and wherein subassembly is accessible from the opening.

5. The printing device of claim 1 wherein the drive mechanism moves the printbar from a print position proximate the media support mechanism when printing to a remote position distal from the media support mechanism when not printing.

6. The printing device of claim 1 comprising a controller having detachable signal pathways operably coupled to the subassembly to supply power and data to the printing subassembly.

7. The printing device of claim 6 wherein the detachable signal pathways include flat flexible circuits.

8. The printing device of claim 1 wherein the subassembly includes a fluid supply in fluid communication with the fluid delivery system.

9. A printing device, comprising:

a chassis;

a media support mechanism; and a replaceable, printing subassembly removably coupled to the chassis, the replaceable printing subassembly including:

a printbar;

a fluid delivery system including a pump fluidically coupled to the printbar;

a frame coupled to the fluid delivery system; and a lift mechanism including an actuator to selectively move the printbar with respect to the media support mechanism, wherein the actuator includes a motor and drive and the left mechanism includes a lift guide formed in the frame.

10. The printing device of claim 9 wherein the printbar includes a print head in fluid communication with the pump.

11. The printing device of claim 9 including circuitry to supply power and data to actuate the lift mechanism.

12. A replaceable printing subassembly, comprising a printbar having a print head;

an ink delivery system including a pump fluidically coupled to the print head;

a frame coupled to the ink delivery system;

a lift mechanism including an actuator to selectively move the printbar with respect to the frame; and a service station operably coupled to the frame and having a wiper to clean the print head and cap to cover the print head when not in use, the service station including a guide formed in the frame.

13. The replaceable printing subassembly of claim 12, wherein the printbar includes a printbar element having a width and a plurality of print heads spanning the width of the printbar element.

* * * * *